US005524454A

United States Patent [19]

Hollingsworth

[11] Patent Number: 5,524,454

[45] Date of Patent: Jun. 11, 1996

[54] WASTE OIL FIRED AIR CONDITIONING APPARATUS

[76] Inventor: Bruce Hollingsworth, c/o P.O. Box 3637, Moscow, Id. 83843

[21] Appl. No.: 291,958

[22] Filed: Aug. 17, 1994

[51] Int. Cl.[6] ..... F25B 15/00; F25B 27/00

[52] U.S. Cl. ..... 62/497; 62/105

[58] Field of Search ..... 62/101, 103, 104, 62/105, 476, 497; 122/17, 19, 14; 165/62

[56] References Cited

U.S. PATENT DOCUMENTS

| | | | |
|---|---|---|---|
| 3,166,914 | 1/1965 | Hallatt | 62/101 |
| 4,162,887 | 7/1979 | Gray | 431/28 |
| 4,238,873 | 12/1980 | Frank et al. | 126/443 |
| 4,251,997 | 2/1981 | Newton | 62/101 |
| 4,273,184 | 6/1981 | Tanaka et al. | 165/62 X |
| 4,304,955 | 12/1981 | Meckler | 136/259 |
| 4,577,471 | 3/1986 | Meckler | 62/271 |
| 5,086,800 | 2/1992 | Dunn | 137/1 |
| 5,221,043 | 6/1993 | Hardy | 237/19 |
| 5,263,340 | 11/1993 | Sekoguchi et al. | 62/497 |
| 5,383,341 | 1/1995 | Zur et al. | 62/476 |

*Primary Examiner*—Henry A. Bennett
*Assistant Examiner*—William C. Doerrler
*Attorney, Agent, or Firm*—Hovey, Williams, Timmons & Collins

[57] ABSTRACT

An absorption air conditioning system wherein a heat transfer fluid circulation system delivers heat from a waste oil burner to the generator of an absorption air conditioner. The generator is heated and endothermic reactants therein separated by contact with the warmed heat transfer fluid. High-temperature oil pumps and a heat-resistant oil storage tank are used to accomplish circulation of the heat transfer fluid. The invention includes the controls and monitors necessary for safe and efficient operation.

14 Claims, 1 Drawing Sheet

WASTE OIL FIRED AIR CONDITIONING APPARATUS

FIELD OF THE INVENTION

The present invention relates to absorption air conditioning or refrigeration devices, more particularly to an absorption air conditioning or refrigeration device fired by waste oil.

BACKGROUND

Absorption air conditioning and refrigeration devices are well known in the prior art and generally employ a heat source and highly endothermic reactants, such as halide salts in water as a heat absorption media. Such refrigeration systems operate on a principle of heat absorption by heat exchange with the environment upon contact with endothermic reaction products.

Typically, the working medium in an absorption refrigeration heating cycle is ammonia and water, wherein ammonia vapor is first extracted from and then absorbed into the ammonia solution. Ammonia has a lower boiling point and a higher vapor pressure than water; in ammonia-based systems, ammonia acts as the refrigerant and the ammonia-water solution as the absorbent.

Another example of a working medium is a solution of water and lithium bromide. Water has a lower boiling temperature and a higher vapor pressure in the gaseous phase for a specified temperature than does a solution of lithium bromide. Water in a lithium bromide solution functions as the ammonia refrigerant in the ammonia working medium. Theoretically, any substances having a high endothermic affinity for one another and which can be separated by heating may be used in an absorption refrigeration system.

This disclosure focuses upon the step in the absorption cooling process where a liquid solution is heated and the working medium having the lower boiling point is vaporized.

Assemblies for absorption air conditioners previously contemplated generally rely upon gas or furnace fuel burners for generation of the requisite heat and are not capable of being fired by waste oil.

Waste oil is extremely viscous and may be laden with a variety of contaminants. As a result, waste oil burners typically generate heavy soot and ash deposits. These byproducts of combustion are highly acidic and corrosive which precludes the use of waste oil burners in certain contexts.

Prior attempts at utilizing waste oil to fire an absorption air conditioning device have failed for primarily this reason. Because gas and furnace fuel burn cleanly, such burners may be fired directly on the outside surface of the air conditioner "generator" wherein the reactant solution is heated and the refrigerant vaporized. However, a generator heated directly by a waste oil burner would be susceptible to corrosion, the accumulation of ash, and dissemination of foul odors.

Despite these obstacles to the use of waste oil burners, controlled combustion of this hazardous waste is the disposal method preferred by the Environmental Protection Agency. Alternative methods of waste oil disposal, such as storage in underground tanks, involve risks of dangerous soil and water contamination.

Although waste oil is generated in all regions of the United States, heretofore waste oil burners were only of practical use in those states with cooler climates and a need for heat in winter months. Before the creation of a waste oil-fired air conditioning system, southern-tier states with little or no need for heat have had to pay costly fees to transport and recycle or properly dispose of waste oil. With the development of the present invention, waste oil can be inexpensively and efficiently disposed of in such areas while generating heat necessary for operation of an absorption air conditioning device.

BACKGROUND: PRIOR ART

Although absorption air conditioners are well known in the prior art, no prior U.S. patents were found wherein waste oil can be used for heat generation. Absorption air conditioning systems are typically heated with gas or furnace fuel burners. The acidic, corrosive properties of waste oil and its extremely high viscosity make waste oil unsuitable for use in such systems.

The following U.S. patents are illustrative of the state of the art in the field of the invention: U.S. Pat. No. 2,350,115, Katzow; U.S. Pat. No. 3,541,013 Macriss et al.; U.S. Pat. No. 3,609,086 Modahl et al.; and U.S. Pat. No. 4,055,964 Swenson et al. All the patents cited utilize absorption cooling theory and rely upon gas or oil as the source of requisite heat.

Although no prior U.S. patents for absorption air conditioning systems were found capable of utilizing a waste oil burner as a source of heat, there have been prior, informal attempts at designing such a system.

Prior attempts at operation of a waste oil fired absorption air conditioning system have utilized direct flame heat or indirect steam generation. These attempts have failed primarily due to the corrosive nature of waste oil combustion byproducts and the insufficient temperatures achieved through steam heat.

SUMMARY OF THE INVENTION

In view of the foregoing disadvantages inherent in the known types of air conditioning assemblies now present in the prior art, the present invention provides an air conditioning apparatus wherein the same utilizes waste oil as the source of heat energy required to operate an absorption air conditioner.

The present invention provides an absorption air conditioning device which is less expensive to operate than conventional systems fired by gas or furnace fuel. The subject invention further provides an inexpensive and efficient method of waste oil disposal while providing air conditioning in warm regions.

The present invention is simple in design and composed of common, inexpensive materials; it is, therefore, conducive to a low cost of manufacture and sale to the consuming public. The subject air conditioning device is also designed such that parts are easily and inexpensively repaired or replaced for longer and more economical use.

The present invention is further designed to be of durable and reliable construction.

The subject invention is capable of providing air conditioning without the use of freon, a chemical believed to contribute to the deterioration of the earth's ozone layer and to resultant "global warming."

As such, the general purpose of the present invention, which will be described subsequently in greater detail, is to provide a new and improved waste oil fired air conditioning apparatus which has all the advantages of the prior art and none of the disadvantages.

To attain this, the present absorption air conditioning invention provides a waste oil-fired burner and a circulation system wherein heat from the burner is transferred by,synthetic heat transfer fluid to the generator of an absorption air conditioner. High-temperature oil pumps and a heat-resistant fuel storage tank are used to accomplish circulation of the heat transfer fluid. The invention also includes the controls and monitors necessary for safe and efficient operation.

My invention resides not in any one of these features, per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

OBJECTS AND ADVANTAGES

It is therefore an object of the present invention to provide a new and improved air conditioning apparatus which has all the advantages of the prior art and none of the disadvantages.

It is also an object of the present invention to provide a new and improved absorption air conditioning apparatus capable of utilizing waste oil as a fuel for operation. The present invention is also designed to provide a safe and economical method of waste oil disposal in warm regions of the country.

It is another object of the present invention to provide a new and improved air conditioning apparatus which is less expensive to operate than the prior art which uses gas or furnace fuel.

It is a further object of the present invention to provide an air conditioning system which does not require the use of freon.

It is a still further object of the present invention to provide a new and improved air conditioning apparatus which may be easily and efficiently manufactured and marketed.

Yet a further object of the present invention is to provide a new and improved air conditioning apparatus of durable and reliable construction, with component parts susceptible to simple and economical repair or replacement.

One further object of the present invention is to provide a new and improved air conditioning apparatus susceptible of a low cost of manufacture with regard to both materials and labor, and which accordingly is then susceptible of a low price of sale to the consuming public, thereby making such air conditioning apparatus economically available to the buying public.

There, together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

Other objects and advantages of the present invention will become more readily apparent after considering the following drawings and description.

REFERENCE NUMERALS IN DRAWINGS

2 Heat transfer fluid storage tank
**2*a*** Tank inlet opening
**2*b*** Tank vent
**2*c*** Tank outlet valve
4 Heat-resistant oil pump
6 Oil filter
8 Steel pipe
10 Burner combustion chamber
12 Waste oil burner
14 Exhaust flue
16 Heat transfer fluid line
18 Steel pipe
20 Heat-resistant oil pump
22 Oil filter
24 Steel pipe
26 Absorption air conditioner generator
28 Absorption air conditioner
30 Heat transfer fluid line
32 Steel pipe

DESCRIPTION OF THE DRAWINGS

The various objects, advantages, and novel features of the invention will be more readily understood from the following detailed description, in which like reference characters refer to like parts, and in which.

DETAILED DESCRIPTION OF PREFERRED EMBODIMENT

Figure 1:
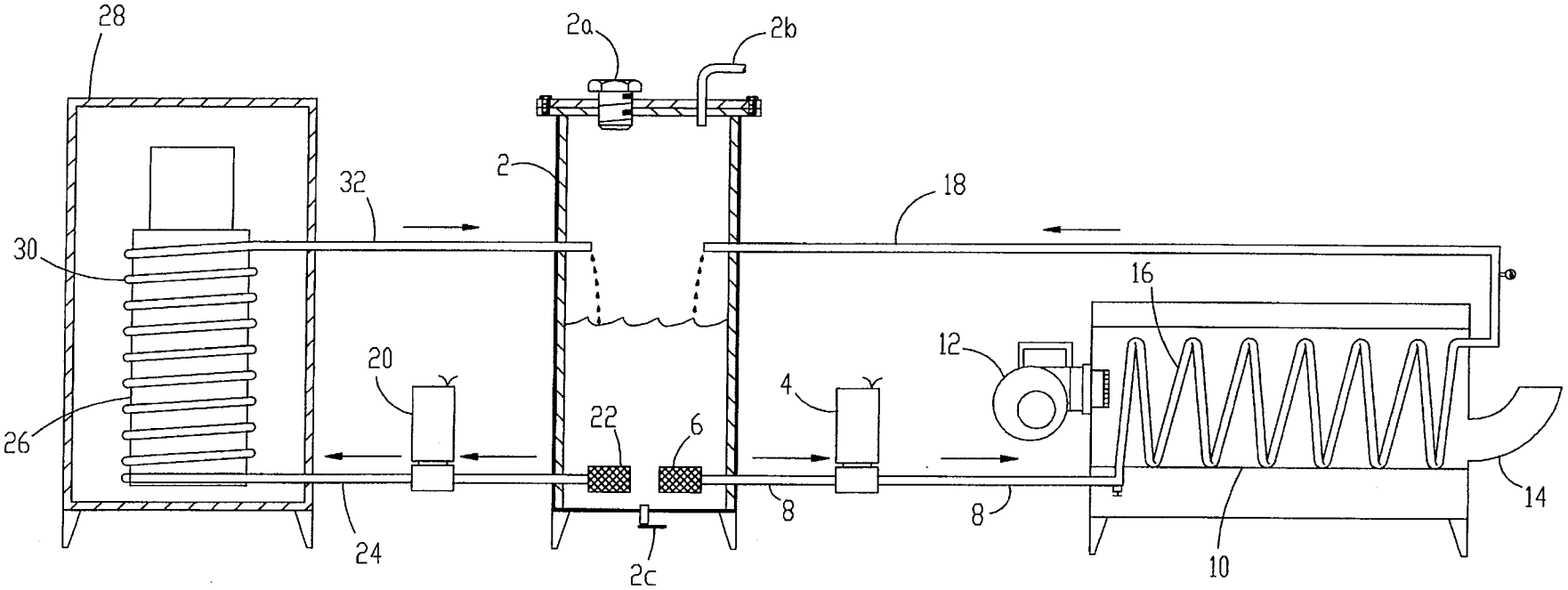
FIG. 1 is a side view of the preferred embodiment of the invention.

Embodiment of FIG. 1.

Heat transfer fluid is contained in a heat-resistant storage tank 2 possessing an inlet opening **2*a*, an air vent 2*b* and an outlet valve 2*c*. In the preferred embodiment, the heat transfer fluid is a high temperature oil suitable for the transfer of heat under conditions and in accordance with the practice of the present invention, as described and shown herein. Storage tank 2, in the preferred embodiment, may be insulated by conventional means to make it heat-resistant. Heat transfer fluid is pumped by a high-temperature oil pump 4 through an oil filter 6 and into a length of steel pipe 8 which transfers the fluid into the combustion chamber 10 of a waste oil burner 12**.

A waste oil burner 12 is fired into the combustion chamber 10 which possesses an exhaust flue 14 for the escape of fumes. The interior of the burner combustion chamber 10 is lined with a coiled length of hollow tubing 16 containing the synthetic heat transfer fluid from the storage tank 2. Therein, the heat transfer fluid is heated to approximately 600 degrees Fahrenheit. The tubing 16 containing heat transfer fluid then exits the combustion chamber 10 through a length of steel pipe 18 and returns to the storage tank 2.

Heat transfer fluid, hot from exposure to the waste oil burner combustion chamber 10, is then pumped by another high-temperature oil pump 20, through an oil filter 22 from the storage tank 2. A length of steel pipe 24 carries the heat transfer fluid to the generator 26 of an absorption air conditioner 28.

Tubing 30 containing heat transfer fluid is wrapped in coil fashion about the exterior surface of the air conditioner generator 26 wherein endothermic reactants are separated by the addition of heat.

The heat transfer fluid is then returned by steel pipe 32 to the storage tank 2 for recycling to the waste oil burner combustion chamber 10.

In the preferred embodiment, conventional electronic and mechanical controls are provided to prevent the system from overheating and to allow the system to be thermostatically controlled.

I claim:

1. A system for supplying heat to the generator of an absorption air conditioning system comprising:

a) a storage tank for a heat transfer fluid;

b) a first pipe connecting the storage tank to a first high temperature fluid pump;

c) a second pipe connecting said first high temperature fluid pump to a length of tubing coiled inside a combustion chamber associated with a waste oil burner such that said tubing will be in proximity of the waste oil burner flame, wherein the heat transfer fluid is heated;

d) a third pipe connecting said coiled tubing to said storage tank;

e) a fourth pipe connecting said storage tank to a second high temperature fluid pump;

f) a fifth pipe connecting said second high temperature fluid pump to a length of tubing coiled around the generator of the absorption air conditioning device transferring heat from the heat transfer fluid to the generator; and g) a sixth pipe connecting the coiled tubing around the generator to the storage tank.

2. The system for supplying heat to the generator of an absorption air conditioner as described in claim 1, wherein the storage tank further comprises an inlet opening, an outlet opening and an air vent.

3. The system for supplying heat to the generator of an absorption air conditioner as described in claim 1, further comprising a filter on the tank end of the first pipe and the fourth pipe.

4. A system for supplying heat to a generator of an absorption air conditioning system, comprising:

a) a storage tank containing a heat transfer fluid;

b) a waste oil burner operative to burn waste oil and thereby generate a waste oil flame, said waste oil burner having tubing that will be in sufficient proximity to the waste oil burner flame associated with said waste oil burner so that the waste oil burner flame heats said tubing;

c) first pump means for transferring said heat transfer fluid from said storage tank to and through said burner tubing so that said fluid is heated as it passes through said tubing, said first pump means thereafer returning said heated heat transfer fluid to said storage tank;

d) an absorption air conditioning device including a generator, said generator including tubing in sufficient proximity to said generator so that when said tubing is heated, heat will be transferred from said generator tubing to said generator; and e) second pump means for transferring said heat transfer fluid from said storage tank to and through said generator tubing so that heat is transferred from said fluid flowing through said generator tubing to said generator.

5. A system for supplying heat to the generator of an absorption air conditioning system, comprising:

a) a storage tank containing heat transfer fluid;

b) a waste oil burner operative to burn waste oil and thereby generate heat;

c) an absorption air conditioning device including a generator;

d) a first heat transfer means for transferring at least a portion of said heat generated by said waste oil burner to said heat transfer fluid in said storage tank; and e) a second heat transfer means for transferring to said generator at least a portion of said heat transferred to said fluid in said storage tank.

6. A system as set forth in claim 5, a) said waste oil burner including a combustion chamber; and b) said first heat transfer means comprising a first pipe connecting the storage tank to a first high temperature fluid pump, c) a second pipe connecting said first high temperature pump to a length of tubing coiled inside the combustion chamber of the waste oil burner such that said tubing will be in the proximity of the waste oil burner flame, wherein the heat transfer fluid is heated, and d) a third pipe connecting said coiled tubing to said storage tank.

7. A system as set forth in claim 5, a) said second heat transfer means comprising a first pipe connecting said storage tank to a second high temperature fluid pump, b) a second pipe connecting said second high temperature fluid pump to a length of tubing coiled around the generator of said air conditioning device for transferring heat from the heat transfer fluid to the generator, and c) a third pipe connecting the coiled tubing around the generator to the storage tank.

8. A heat source system for generating heat from the combustion of waste oil, comprising:

a) a waste oil burner operative to burn waste oil and thereby generate heat;

b) a storage tank containing a heat transfer fluid;

c) a first heat transfer means for transferring at least a portion of said heat generated by said waste oil burner to said heat transfer fluid in said storage tank to increase the heat content thereof;

d) a heat accepting means; and e) a second heat transfer means for transferring heat from said heat transfer fluid in said storage tank to said heat accepting means.

9. A heat source system as set forth in claim 8, a) said waste oil burner including a combustion chamber; and b) said first heat transfer means comprising a first pipe connecting the storage tank to a first high temperature fluid pump, c) a second pipe connecting said first high temperature pump to a length of tubing coiled inside the combustion chamber of the waste oil burner such that said tubing will be in the proximity of the waste oil burner flame, wherein the heat transfer fluid is heated, and d) a third pipe connecting said coiled tubing to said storage tank.

10. A system as set forth in claim 8, a) said heat accepting means comprising a absorption air conditioning device including a generator;

b) said second heat transfer means comprising a first pipe connecting said storage tank to a second high temperature fluid pump, c) a second pipe connecting said second high temperature fluid pump to a length of tubing coiled around the generator of said air conditioning device for transferring heat from the heat transfer fluid to the generator, and d) a third pipe connecting the coiled tubing around the generator to the storage tank.

11. A system as set forth in claim 8, a) said heat accepting means comprising an absorption air conditioning device.

12. A method of supplying heat to the generator of an absorption air conditioning system, comprising:

a) providing waste oil burner and burning waste oil therein to generate heat;

b) providing an oil storage tank containing heat transfer fluid;

c) transferring at least a portion of said heat generated by said waste oil burner to said heat transfer fluid in said storage tank;

d) providing an absorption air conditioning devise including a generator; and e) transferring to said generator of said absorption air conditioning devise at least a portion of said heat transferred from said waste oil burner to said heat transfer fluid in said storage tank.

13. A system for generating heat, comprising:

a) providing waste oil burner and burning waste oil therein to generate heat;

b) providing an oil storage tank containing heat transfer fluid;

c) transferring at least a portion of said heat generated by said waste oil burner to said heat transfer fluid in said storage tank;

d) providing a heat accepting means; and e) transferring to said heat accepting means at least a portion of said heat transferred from said waste oil burner to said heat transfer fluid in said storage tank.

14. A method as set forth in claim 13, a) said heat accepting means being in the form of an absorption air conditioning device having a generator.

* * * * *